US007404701B2

(12) United States Patent
Kwon et al.

(10) Patent No.: US 7,404,701 B2
(45) Date of Patent: Jul. 29, 2008

(54) REFRIGERATING SYSTEM HAVING RECIPROCATING COMPRESSOR

(75) Inventors: Gi-Bong Kwon, Gyeongsangnam-Do (KR); Won-Hyun Jung, Gyungsangnam-Do (KR); Su-Won Lee, Gyungsangnam-Do (KR); Dong-Won Lee, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 353 days.

(21) Appl. No.: 10/539,310

(22) PCT Filed: Jul. 10, 2003

(86) PCT No.: PCT/KR03/01373

§ 371 (c)(1),
(2), (4) Date: Jun. 16, 2005

(87) PCT Pub. No.: WO2004/057186

PCT Pub. Date: Jul. 8, 2004

(65) Prior Publication Data

US 2006/0051220 A1 Mar. 9, 2006

(30) Foreign Application Priority Data

Dec. 20, 2002 (KR) ..... 10-2002-0081900

(51) Int. Cl.
*F04B 17/04* (2006.01)
*F25B 31/00* (2006.01)
*F25B 43/02* (2006.01)

(52) U.S. Cl. ..... 417/417; 62/193; 62/468; 252/68

(58) Field of Classification Search ..... 417/416, 417/417, DIG. 1; 252/67, 68, 69; 418/100; 62/84, 193, 468
See application file for complete search history.

(56) References Cited

U.S. PATENT DOCUMENTS 2,865,559 A 12/1958 Gigler (Continued)

FOREIGN PATENT DOCUMENTS

EP 1 170 506 A1 1/2002

(Continued)

OTHER PUBLICATIONS

Chevron Group II Neutral Oils Typical Properties, Feb. 17, 2001, http://web.archive.org/web/20010217041255/www.chevron.com/prodserv/BaseOils/neutral_prop.htm.*

(Continued)

*Primary Examiner*—Charles G Freay
(74) *Attorney, Agent, or Firm*—Birch, Stewart, Kolasch & Birch, LLP

(57) ABSTRACT

A refrigerating system includes: an evaporator (2) for performing a cooling operation as a refrigerant is evaporated; a compressor (4) for compressing the refrigerant discharged from the evaporator as a mover is reciprocally moved; a condenser (86) for changing the refrigerant compressed in the reciprocating compressor to a liquid refrigerant; and a capillary tube (8) for decompressing the refrigerant discharged from the condenser and transferring it to the evaporator. Hydrocarbon consisting of carbon and hydrogen, a sort of natural refrigerant, is used as the refrigerant, and a paraffin-based lubricant, a sort of a mineral oil, is used as the lubricant, so that a lubricating performance and a performance of the refrigerating system can be improved.

15 Claims, 2 Drawing Sheets

U.S. PATENT DOCUMENTS

| | | | | |
|---|---|---|---|---|
| 3,814,550 | A * | 6/1974 | Adams | 417/417 |
| 4,770,763 | A * | 9/1988 | Kusayanagi et al. | 208/18 |
| 5,185,092 | A * | 2/1993 | Fukuda et al. | 508/440 |
| 5,342,533 | A * | 8/1994 | Kondo et al. | 252/68 |
| 5,704,216 | A * | 1/1998 | Hirano et al. | 62/114 |
| 5,809,792 | A * | 9/1998 | Song | 62/115 |
| 5,956,959 | A * | 9/1999 | Sunaga et al. | 62/114 |
| 5,964,581 | A * | 10/1999 | Iizuka et al. | 417/410.3 |
| 6,089,352 | A * | 7/2000 | Kim et al. | 184/6.16 |
| 6,202,791 | B1 * | 3/2001 | Oh et al. | 184/6.16 |
| 6,409,484 | B1 | 6/2002 | Hyun | |
| 6,435,842 | B2 * | 8/2002 | Song | 417/363 |
| 6,491,506 | B1 * | 12/2002 | Oh et al. | 417/417 |
| 6,575,716 | B1 * | 6/2003 | Morita et al. | 417/417 |
| 6,877,326 | B2 * | 4/2005 | Kim | 62/6 |

FOREIGN PATENT DOCUMENTS

| | | | |
|---|---|---|---|
| JP | 08200224 | A * | 8/1996 |
| JP | 2000-309790 | A | 11/2000 |
| JP | 2003003958 | A * | 1/2003 |

OTHER PUBLICATIONS

Chevron Group II Neutral Oils Features and Benefits, Feb. 17, 2001, http://web.archive.org/web/20010217040328/www.chevron.com/prodserv/BaseOils/neutral.htm.*

Wayback Machine Internet Archive records for Chevron Group II Neutral Oils webpages, http://web.archive.org/web/*/www.chevron.com/prodserv/BaseOils/neutral_prop.htm.*

* cited by examiner

REFRIGERATING SYSTEM HAVING RECIPROCATING COMPRESSOR

TECHNICAL FIELD

The present invention relates to a refrigerating system for performing a compressing operation on a refrigerant by a reciprocating compressor and, more particularly, to a refrigerating system having a reciprocating compressor that is capable of improving a lubrication performance and a performance of a refrigerating system as well by using a lubricant having an excellent compatibility with a natural gas for a reciprocating compressor of the refrigerating system which uses the natural gas.

BACKGROUND ART

As chlorofluorocarbon (CFC), a refrigerant used for a refrigerator, an air-conditioner or the like, has been known as a source material damaging an ozone layer of the stratosphere, research on a substitute refrigerant is being actively conducted.

The CFC comprises R11 (trichloromonogluoromethane), R12 (dichlorodifluoromethane), R13 and the like, of which R12 mainly used as a refrigerant for a refrigerator is one of regulation-subject materials as being a source material causing an ozone layer reduction and generating a global warming effect. Thus, researches on a natural refrigerant is being actively conducted as a substitute refrigerant.

The natural refrigerant refers to a material used as a refrigerant which naturally exists in the globe such as water, ammonia, nitride, carbon dioxide, propane, butane and the like, not an artificial compound. Known that it does not have a bad influence on the global environment, application of the natural refrigerant as a refrigerant is positively reviewed.

Among the natural refrigerants, hydrocarbon comprises only carbon and hydrogen and includes methane (R50), ethane (R170), propane (R290), butane (R600), isobutane (R600a), propylene (R1270) or the like. The hydrocarbon is not toxic, chemically stable and especially exhibits an appropriate solubility in a mineral oil.

In addition, the hydrocarbon has a zero ozone depletion potential and a very low global warming index. That is, when a global warming index of carbon dioxide is admitted as '1', a global warming index of R12 is 7100, R134a is 1200, while propane is very low, 3.

Especially, isobutane (R600a) is an environmental-friendly natural gas which does not damage the ozone layer and has no influence on a greenhouse effect. That is, isobutane (R600a), a sort of a natural gas obtained by refining hydrocarbon gas created in an oil refining process to a high degree of purity, is a refrigerant containing no environmentally detrimental factor.

However, with all those advantages, isobutane (R600a) is hardly combined with refrigerant oil currently used for a refrigerating system due to its chemical and electrical properties. Therefore, a refrigerant oil suitable for isobutane (R600a) is in need of development. Especially, necessity of a refrigerant oil usable for a reciprocating compressor for compressing isobutane (R600a) comes to the front.

FIG. 1 illustrates a construction of a refrigerating cycle of a general refrigerating system.

As shown In FIG. 1, a currently used refrigerating cycle includes: an evaporator 2 for performing a cooling operation as a low temperature and low pressure liquid refrigerant is evaporated; a compressor 4 for compressing the low temperature and low pressure gaseous refrigerant discharged from the evaporator 2 to a high temperature and high pressure gaseous refrigerant; a condenser 6 for changing the high temperature and high pressure gaseous refrigerant discharged from the compressor 4 to a high temperature and high pressure liquid refrigerant; and a capillary tube 8 for decompressing the refrigerant discharged from the condenser 6 so as to be easily evaporated and transferring it to the evaporator 2.

The refrigerant used for the refrigerating system is a natural refrigerant, and hydrocarbon is especially used.

Since the lubricant 50 used for the reciprocating compressor of the refrigerating system is used as a refrigerant oil for the compressor compressing a natural refrigerant, its physical and chemical characteristics should be in good harmony with the natural refrigerant.

Namely, the lubricant used as the refrigerant oil of the reciprocating compressor needs to have characteristics that it can protect well an oil film even though the refrigerant is dissolved, and should be thermally and chemically stable so as not to react in spite of being in contact with the refrigerant and an organic material metal at a high temperature or at a low temperature, and should have a high level thermal stability so as not to generate a carbon sludge or not to be oxidized at a high temperature part of the compressor.

In order to satisfy those characteristics, characters of the lubricant, such as a kinematic viscosity, a pour point, a density, a total acid number, a water content or the like, work as critical factors.

Therefore, if the lubricant used for the reciprocating compressor compressing the natural refrigerant is not well harmonized with the refrigerant of the refrigerator, the oil would be leaked. Then, oil circulation is deteriorated to degrade a heat transfer performance of the refrigerator and a lubrication performance, resulting in that frictional portions of each motional part are abraded and thus each part is damaged.

DISCLOSURE OF THE INVENTION

Therefore, it is an object of the present invention to provide a refrigerating system having a reciprocating compressor that is capable of improving a lubrication performance and a performance of a refrigerating system as well by using a natural gas as a refrigerant for the refrigerating system and using a lubricant well harmonized with the natural gas for the reciprocating compressor.

To achieve these objects, there is provided a reciprocating compressor including: an evaporator for performing a cooling operation as a refrigerant is evaporated; a reciprocating compressor which includes a driving unit having a stator consisting of an outer stator fixed inside a hermetic container, an inner stator disposed with a certain air gap with an inner circumferential surface of the outer stator, and a winding coil wound at one of the outer stator and the inner stator, to which power is applied from an external source, a mover consisting of magnets disposed at regular intervals between the outer stator and the inner stator and linearly and reciprocally moved when power is applied to the winding coil and a magnet frame, in which the magnets are mounted, for transmitting a linear reciprocal motional force to a compression unit, a compression unit for performing a compressing operation on a refrigerant upon receiving the linear reciprocal motional force of the driving unit, and a lubrication unit for supplying the lubricant, a sort of a mineral oil, to each motional portion of the driving unit and the compression unit and performing a lubricating operation; a condenser for changing the refrigerant compressed in the reciprocating compressor to a liquid refrigerant; a capillary tube for decompressing the refrigerant discharged from the condenser and transmitting it to the evaporator; an organic compound refrigerant sucked into the evaporator and comprising carbon and hydrogen, a sort of natural refrigerant, and having combustibility and explosiveness; and a mineral-based lubricant stored inside a hermetic container of the reciprocating compressor and performing a lubricating operation on each sliding part.

In the refrigerating system of the present invention, a controller is additionally provided to vary a capacity of the compressor according to an ambient temperature and environment.

In the refrigerating system of the present invention, the controller determines an output value according to a phase difference between a current and a voltage.

In the refrigerating system of the present invention, the compression unit includes a piston connected to the mover and linearly and reciprocally moved; a cylinder, into which the piston is slidably inserted, forming a certain compression chamber; a suction valve mounted at a refrigerant passage 56 formed at the piston and preventing a backflow of the refrigerant after being introduced into the compression chamber; and a discharge valve mounted at the front side of the cylinder and performing an opening and closing operation on a compressed refrigerant.

In the refrigerating system of the present invention, the lubrication unit includes a lubricant pumping unit for pumping a lubricant filled with a certain amount at a lower portion of the hermetic container; and a lubricant supply passage for supplying the lubricant pumped by the lubricant pumping unit to a frictional portion between the piston and the cylinder.

In the refrigerating system of the present invention, isobutane (R600a) which is hydrocarbon-based and has a molecular formula of $CH(CH_3)_3$ is used as the refrigerant.

In the refrigerating system of the present invention, the lubricant Is a paraffin-based lubricant.

In the refrigerating system of the present invention, the lubricant has a density of 0.866~0.880 g/cm$^3$ and a flash point of above 140° C.

In the refrigerating system of the present invention, the lubricant has a kinematic viscosity of 7.2~21.8 MM2/s at a temperature of 40° C. and a viscosity index of 73~99.

In the refrigerating system of the present invention, the lubricant has a flow point of below −25° C. and a total acid number of below 0.01 mgKOH/g.

In the refrigerating system of the present invention, the lubricant has a water content of below 20 ppm and a breakdown voltage of above 30 kV.

MODES FOR CARRYING OUT THE PREFERRED EMBODIMENTS

Figure 1:
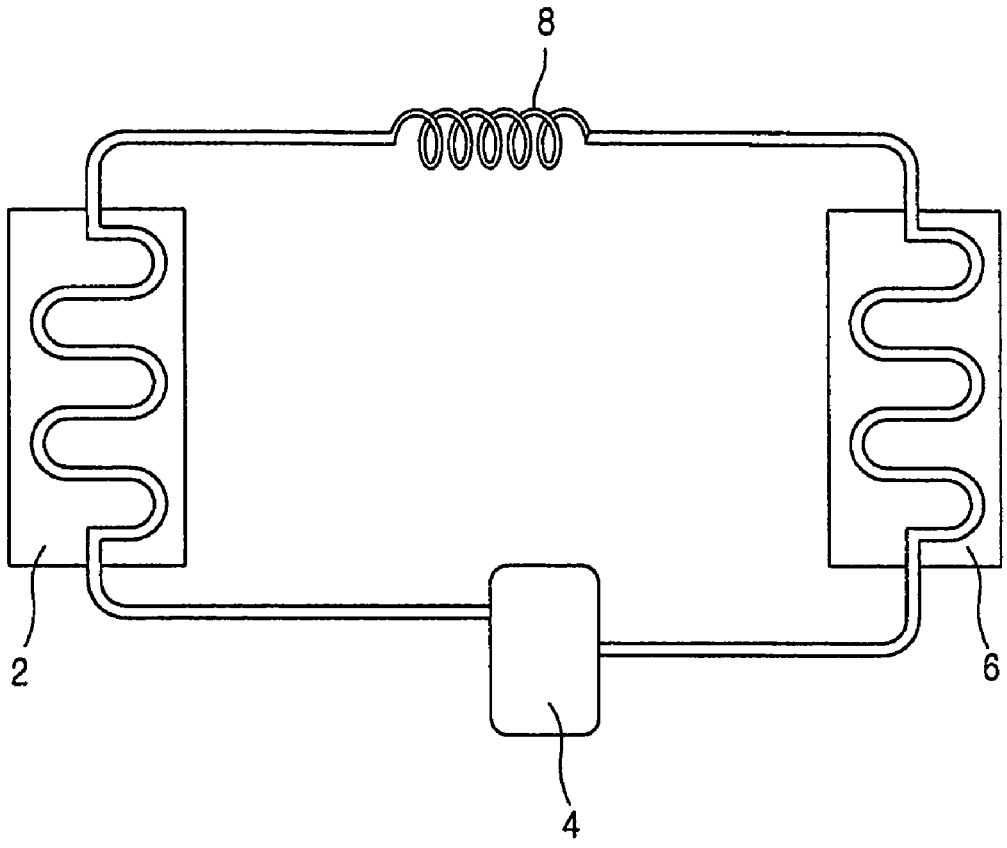
FIG. 1 shows a construction of a refrigerating cycle of a general refrigerating system.
Figure 2:
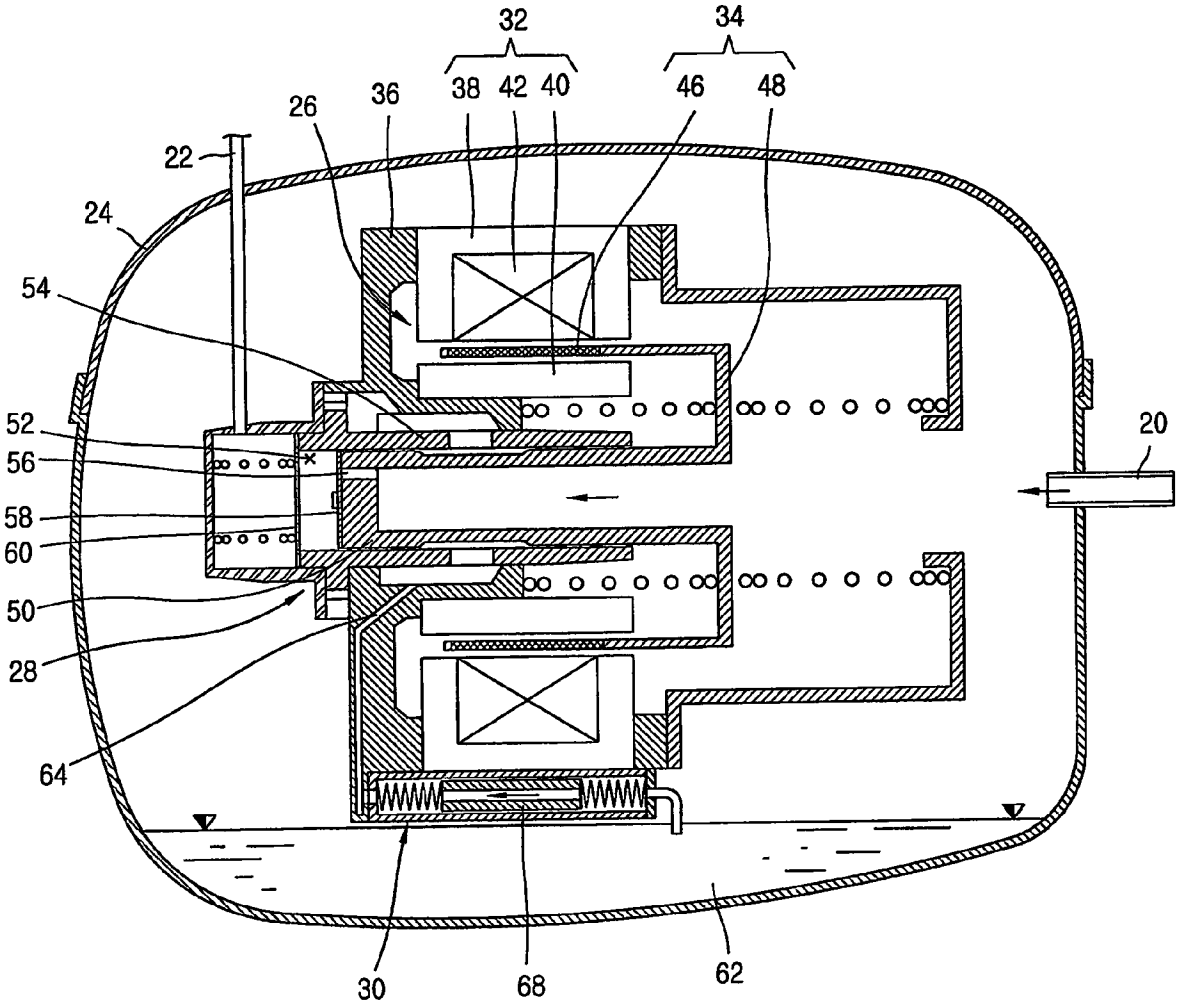
FIG. 2 is a sectional view of a general reciprocating compressor.

FIG. 1 shows a construction of a refrigerating cycle of a general refrigerating system, and FIG. 2 is a sectional view of a general reciprocating compressor.

The refrigerating cycle of the refrigerating system includes: an evaporator 2 for performing a cooling operation as a low temperature and low pressure liquid refrigerant is evaporated; a compressor 4 for compressing the low temperature and low pressure gaseous refrigerant discharged from the evaporator 2 to a high temperature and high pressure gaseous refrigerant; a condenser 6 for changing the high temperature and high pressure gaseous refrigerant discharged from the compressor 4 to a high temperature and high pressure liquid refrigerant; and a capillary tube 8 for decompressing the refrigerant discharged from the condenser 6 so as to be easily evaporated and transferring it to the evaporator.

The refrigerating system includes a controller (not shown) which determines an output value according to a phase difference between a current and a voltage in order to vary a capacity of the compressor depending on an ambient temperature and environment.

As shown in FIG. 2, the compressor 4 includes: a hermetic container 24 to which a suction pipe 20 for sucking a refrigerant and a discharge pipe 22 for discharging a compressed refrigerant; a driving unit 26 disposed inside the hermetic container 24 and generating a reciprocal motional force; a compression unit 28 for performing a compressing operation on the refrigerant upon receiving a reciprocal motional force generated from the driving unit 26; and a lubrication unit 30 for performing a lubrication operation on each motional portion of the driving unit 26 and the compression unit 28.

The driving unit 26 consists of a stator 32 fixed inside the hermetic container 24, and a mover 34 disposed spaced apart from the stator 32 and linearly and reciprocally moved by an interaction with the stator 32 when power is applied to the stator 32.

The stator 32 includes a cylindrical outer stator 38 fixed by a support frame 36 fixed inside the hermetic container 24, an inner stator 40 disposed with a certain air gap with an inner circumferential surface of the outer stator 38, and a winding coil 42 wound inside the outer stator 38 to which power is applied from an external source.

The mover 34 includes a magnet 46 disposed with a certain space between the outer stator 38 and the inner stator 40 and linearly and reciprocally moved when power is applied to the winding coil 42, and a magnet holder 48 having magnets 46 mounted at equal intervals at its an outer circumferential surface and being connected to a piston 50 of the compression unit 28.

The compression unit 28 includes a piston 50 connected to the magnet holder 48 and linearly and reciprocally moved; a cylinder 54 into which the piston 50 is slidably inserted to form a certain compression chamber 36; a suction valve 58 mounted at a refrigerant passage 56 formed at the piston 50 and preventing a backflow of the refrigerant after being introduced into the compression chamber 52; and a discharge valve 60 mounted at the front side of the cylinder 54 and performing an opening and closing operation on a compressed refrigerant.

The lubrication unit 30 includes a lubricant 62 filled with a certain amount at the lower portion of the hermetic container 24; a lubricant pumping unit 68 for pumping the lubricant 62; and a lubricant supply passage 64 for supplying the lubricant 62 pumped by the lubricant pumping unit 68 to a frictional portion between the piston 50 and the cylinder 54.

The operation of the refrigerating system constructed as described above will now be explained.

When the compressor 4 is driven, the low temperature and low pressure gaseous refrigerant is compressed to a high temperature and high pressure gaseous refrigerant, which is then introduced into the condenser 6 and changed to a liquid refrigerant. The liquid refrigerant discharged from the condenser is decompressed while passing through the capillary tube 8 and then transferred to the evaporator 2. At this time, air is cooled while passing through the evaporator 2 and supplied into the refrigerating system, thereby performing a cooling operation therein.

The operation of the reciprocating compressor will now be described in detail.

When power is applied to the winding coil 42, a flux is formed around the winding coil 42, forming a closed loop along the outer stator 38 and the inner stator 40. By the interaction of the flux formed between the outer stator 38 and the inner stator 40 and the flux formed by the magnet 46, the magnet 46 is linearly moved in an axial direction. When the direction of a current applied to the winding coil 42 is changed in turn, the magnet 46 is linearly and reciprocally moved as the direction of the flux of the winding coil 42 is changed.

Then, the motion of the magnet 46 is transferred to the piston 50 by the magnet holder 48, and accordingly, the piston 50 is linearly and reciprocally moved inside the cylinder 54, thereby performing a compressing operation on the refrigerant.

That is, when the piston 50 is retreated, the refrigerant introduced into the suction pipe 20 is supplied to the compression chamber 52 through the suction passage 56 formed at the piston 50. Meanwhile, when the piston 50 advances, the suction passage 56 is closed by the suction valve 58, the refrigerant inside the compression chamber 52 is compressed, and the compressed refrigerant is externally discharged through the discharge pipe 22.

During the compressing operation, the lubricant 62 filled in the hermetic container 24 is pumped according to operation of the lubricant pumping unit 68 and supplied to the frictional portion between the piston 50 and the cylinder 54 through the lubricant supply passage 64, for a lubricating operation.

An environment-friendly natural refrigerant is used for the refrigerating system constructed and operated as described above.

Among natural refrigerants, an organic compound refrigerant consisting of only carbon and hydrogen is mainly used, of which hydrocarbon has no toxicity, is chemically stable, has a zero ozone depletion potential and a very low global warming index. The hydrocarbon includes R50 (methane), R170 (methane), R290 (propane), R500 (butane), R600a (isobutane) or R1270 (propylene), etc.

Especially, isobutane (R600a) is a hydrocarbon-based, has a molecular formula of $CH(CH_3)_3$, and Is an environment-friendly natural gas which does neither damage an ozone layer and nor affect a greenhouse effect. As such, isobutane (R600a) is used as a refrigerant compressing by the reciprocating compressor in the present invention.

As the lubricant 50 for making a lubricating operation for the reciprocating compressor of the present invention, a mineral oil is used which has a favorable compatibility with hydrocarbon and satisfies physical and chemical characteristics.

The mineral oil is divided into a paraffin-based mineral oil and a naphtan-based mineral oil. In the present invention, the paraffin-based mineral lubricant is used.

It is preferred that the paraffin-based lubricant has a density of 0.866~0.880 g/cm$^3$ at a temperature of 15° C.

A flash point of the paraffin-based lubricant varies depending on a size and a type of the reciprocating compressor. Preferably, it is above 140° C., and it can be below 165° C., below 175° C., below 185° C. and below 200° C. according to the type of an adopted compressor.

A kinematic viscosity of the paraffin-based lubricant is preferably 7.2~21.8 mm$^2$/s at a temperature of 40° C., and most preferably, it is 8.29 mm$^2$/s and 10.3 mm$^2$/s depending on the size and type of an adopted reciprocating compressor.

A viscosity index of the paraffin-based lubricant is preferably 73~99.

A flow point of the paraffin-based lubricant is preferably below −25° C.

A total acid number of the paraffin-based lubricant is below 0.01 mgKOH/g.

The total acid number of the lubricant, representing an amount of an acid component contained in an oil, indicates an amount of potassium hydroxide required for neutralizing an acid component contained in 1 g of sample oil by the number of mg.

A water content of the paraffin-based lubricant is preferably below 20 ppm.

A breakdown voltage of the paraffin-based lubricant is preferably above 30 kV.

As so far described, the reciprocating system having a reciprocating compressor of the present invention has such an advantage that since it uses hydrocarbon, the natural refrigerant, and the paraffin-based lubricant, a sort of the mineral oil with an excellent compatibility with hydrocarbon as a lubricant for performing a lubricating operation for the reciprocating compressor. Therefore, a lubricating performance of the reciprocating compressor is improved and a performance of the refrigerating system can be enhanced.

It will be apparent to those skilled in the art that various modifications and variations can be made in the refrigerating system having a reciprocating compressor of the present invention without departing from the spirit or scope of the invention. Thus, it is intended that the present invention cover modifications and variations of this invention provided they come within the scope of the appended claims and their equivalents.

The invention claimed is:

1. A refrigerating system comprising:

an evaporator for performing a cooling operation as a refrigerant is evaporated;

a reciprocating compressor which includes a driving unit having a stator including an outer stator fixed inside a hermetic container, an inner stator disposed with a certain air gap with an inner circumferential surface of the outer stator, and a winding coil wound at one of the outer stator and the inner stator, to which power is applied from an external source, a mover including magnets disposed at regular intervals between the outer stator and the inner stator and linearly and reciprocally moved when power is applied to the winding coil and a magnet frame, in which the magnets are mounted, for transmitting a linear reciprocal motional force to a compression unit, a compression unit for performing a compressing operation on a refrigerant upon receiving the linear reciprocal motional force of the driving unit, and a lubrication unit for performing a lubricating operation;

a condenser for changing the refrigerant compressed in the reciprocating compressor to a liquid refrigerant;

a capillary tube for decompressing the refrigerant discharged from the condenser and transmitting it to the evaporator;

an organic compound refrigerant sucked into the evaporator and comprising carbon and hydrogen, a sort of natural refrigerant, and having combustibility and explosiveness; and a mineral-based lubricant stored inside a hermetic container of the reciprocating compressor and performing a lubricating operation on each sliding part and supplied by the lubrication unit to each motional portion of the driving unit and the compression unit, wherein the mineral-based lubricant has a density of 0.866~0.880 g/cm$^3$, a flash point of above 140° C. and a kinematic viscosity of 7.2~21.8 mm$^2$ /s at a temperature of 40° C. such that the mineral-based lubricant mixes with the organic compound refrigerant to perform the lubricating operation.

2. The refrigerating system of claim 1 further comprising:

a controller for varying a capacity of the compressor according to an ambient temperature and environment.

3. The refrigerating system of claim 2, wherein the controller determines an output value according to a phase difference between a current and a voltage.

4. The refrigerating system of claim 1, wherein the compression unit comprises:

a piston connected to the mover and linearly and reciprocally moved;

a cylinder into which the piston is slidably inserted to form a certain compression chamber;

a suction valve mounted at a refrigerant passage formed at the piston and preventing a backflow of the refrigerant after being introduced into the compression chamber; and a discharge valve mounted at the front side of the cylinder and performing an opening and closing operation on a compressed refrigerant.

5. The refrigerating system of claim 1, wherein the lubrication unit comprises:

a lubricant pumping unit for pumping a lubricant filled with a certain amount at a lower portion of the hermetic container; and a lubricant supply passage for supplying the lubricant pumped by the lubricant pumping unit to a frictional portion between the piston and the cylinder.

6. The refrigerating system of claim 1, wherein isobutane (R600a) which is hydrocarbon-based and has a molecular formula of $CH(CH_3)_3$ is used as the refrigerant.

7. The refrigerating system of claim 1, wherein the lubricant is a paraffin-based lubricant.

8. The refrigerating system of claim 1, wherein the lubricant has a viscosity index of 73~99.

9. The refrigerating system of claim 1, wherein the lubricant has a flow point of below −25° C. and a total acid number of below 0.01 mgKOH/g.

10. The refrigerating system of claim 1, wherein the lubricant has a water content of below 20 ppm and a breakdown voltage of above 30 kV.

11. A refrigerating system comprising:

an evaporator for performing a cooling operation as a refrigerant is evaporated;

a reciprocating compressor which includes a driving unit having a stator including an outer stator fixed inside a hermetic container, an inner stator disposed with a certain air gap with an inner circumferential surface of the outer stator, and a winding coil wound at one of the outer stator and the inner stator, to which power is applied from an external source, a mover including magnets disposed at regular intervals between the outer stator and the inner stator and linearly and reciprocally moved when power is applied to the winding coil and a magnet frame, in which the magnets are mounted, for transmitting a linear reciprocal motional force to a compression unit, a compression unit for performing a compressing operation on a refrigerant upon receiving the linear reciprocal motional force of the driving unit, and a lubrication unit for performing a lubricating operation;

a condenser for changing the refrigerant compressed in the reciprocating compressor to a liquid refrigerant;

a capillary tube for decompressing the refrigerant discharged from the condenser and transmitting it to the evaporator;

an organic compound refrigerant sucked into the evaporator and comprising carbon and hydrogen, a sort of natural refrigerant, and having combustibility and explosiveness; and a mineral-based lubricant stored inside a hermetic container of the reciprocating compressor and performing a lubricating operation on each sliding part and supplied by the lubrication unit to each motional portion of the driving unit and the compression unit, wherein the lubricant has a kinematic viscosity of 7.2~21.8 $mm^2$ /s at a temperature of 40° C. a viscosity index of 73~99 and a density of 0.866~0.880 $g/cm^3$ such that the mineral-based lubricant mixes with the organic compound refrigerant to perform the lubricating operation.

12. The refrigerating system of claim 11, wherein the lubricant is a paraffin-based lubricant.

13. The refrigerating system of claim 11 wherein the lubricant has a flash point of above 140° C.

14. The refrigerating system of claim 11, wherein the lubricant has a flow point of below −25° C. and a total acid number of below 0.01 mgKOH/g.

15. The refrigerating system of claim 11, wherein the lubricant has a water content of below 20 ppm and a breakdown voltage of above 30 kV.

* * * * *